United States Patent [19]

Kobayashi

[11] Patent Number: 4,615,563

[45] Date of Patent: Oct. 7, 1986

[54] VEHICLE SEAT

[75] Inventor: Hideo Kobayashi, Akishimashi, Japan

[73] Assignee: Tachikawa Spring Co., Ltd., Akishimashi, Japan

[21] Appl. No.: 670,368

[22] Filed: Nov. 9, 1984

[51] Int. Cl.[4] ..... A47C 3/00

[52] U.S. Cl. ..... 297/284; 297/456; 297/DIG. 3

[58] Field of Search ..... 297/284, DIG. 1, DIG. 2, 297/DIG. 3, 453, 455, 456, 452

[56] References Cited

U.S. PATENT DOCUMENTS

| | | | |
|---|---|---|---|
| 1,830,570 | 11/1931 | Smith et al. | 297/DIG. 3 |
| 2,684,672 | 7/1954 | Summerville | 297/284 X |
| 3,330,598 | 7/1967 | Whiteside | 297/284 |
| 3,363,941 | 1/1968 | Wierwille | 297/284 |
| 3,770,318 | 11/1973 | Fenton | 297/DIG. 3 |
| 4,444,430 | 4/1984 | Yoshida et al. | 297/DIG. 3 |

*Primary Examiner*—Francis K. Zugel

*Attorney, Agent, or Firm*—Hoffmann, Dilworth, Barrese & Baron

[57] ABSTRACT

An improved vehicle seat such as an automotive seat is disclosed which is formed with through bores respectively in a seat cushion and a seat back, in particular, in the respective connecting portions thereof, harness means is inserted from within the seat cushion into the seat back via the thus-formed two through bores, and the harness is mounted such that it will never be exposed outside of the seat.

3 Claims, 4 Drawing Figures

VEHICLE SEAT

BACKGROUND OF THE INVENTION

1. Field of the Invention

The present invention relates to a vehicle seat such as an automotive seat and, more particularly, to an improved vehicle seat in which a seat cushion and a seat back are formed separately from each other, the seat back is inclinably mounted to the seat cushion, and "harness" means is inserted into the seat back from the seat cushion.

2. Description of the Prior Art

A conventional vehicle seat of this type is shown in FIG. 1. In the conventional vehicle seat, harness means such as an air feed pipe (C) for feeding air to an air bag (a) for a lumbar support section stored within a seat back (A') is exposed. Therefore, there is a possibility that the air feed pipe (C) may catch the foot or feet of an occupant in a rear seat. Also, such exposure of the air feed pipe (C) impairs the appearance of the seat.

SUMMARY OF THE INVENTION

The present invention aims at eliminating the drawbacks found in the above-mentioned prior art seat.

Accordingly, it is a primary object of the invention to provide an improved vehicle seat in which an air feed pipe for feeding air to an air bag provided within a seat back is not exposed outside of the seat back.

In attaining this object, according to one aspect of the invention, a seat cushion and a seat back are formed in their respective connecting portions with through bores which communicate the seat cushion with the seat back, and the above-mentioned harness means is inserted through such through bores, so that the harness means can not been seen from outside.

It is another object of the invention to provide an improved vehicle seat which may not impair its fine appearance.

To accomplish the above object, according to another aspect of the invention, the through bores for insertion of the harness are formed in the connecting portions of the respective seat back and seat cushion which cannot be viewed from outside. For this reason, even if these through bores are expanded or broken by the harness during long periods of use of the seat, the fine appearance of the present seat will not be impaired at all.

It is still another object of the invention to provide an improved vehicle seat which prevents the above-mentioned through bores formed in the seat back and seat cushion from being broken when the harness is inserted into these through bores.

To achieve this object, according to another aspect of the invention, a guide tube is mounted within and through the two through bores and the harness is inserted through this guide tube.

Other objects and advantages of the invention will become apparent during the following discussion of the accompanying drawings.

DETAILED DESCRIPTION OF A PREFERRED EMBODIMENT OF THE INVENTION

Figure 1:
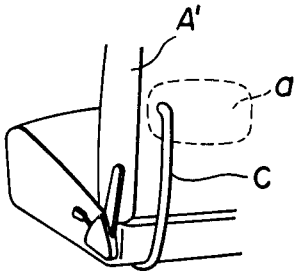
FIG. 1 is a perspective view of a conventional vehicle seat.
Figure 2:
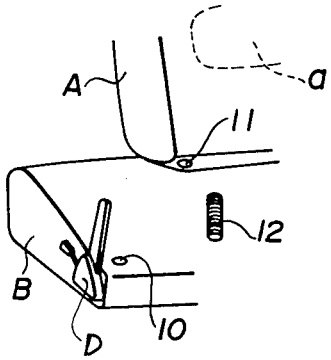
FIG. 2 is an exploded perspective view of a vehicle seat constructed in accordance with the invention.

FIG. 2 illustrates a vehicle seat of the invention before a seat back (A) is mounted to a seat cushion (B). In the drawings, reference character (A) designates a seat back, (B) represents a seat cushion formed separately from the seat back (B), and (a) denotes an air bag stored within a lumbar support section of the seat back (A). The above-mentioned seat back (A) is inclinably connected by a reclining device (D) to the seat cushion (B) and there is stored an air bag within a thigh support section in the seat cushion (B) as well. This air bag designated by (a') and the above-mentioned air bag (a) are respectively connected via air feed tubes (1), (1') to a pump (P) installed on the lower floor surface of the seat cushion (B). This pump (P) is adapted to work and stop by operating an operative device (2) provided on the outside surface of the seat back (A) for controlling the amount of air trapped within the air bags (a), (a').

Figure 3:
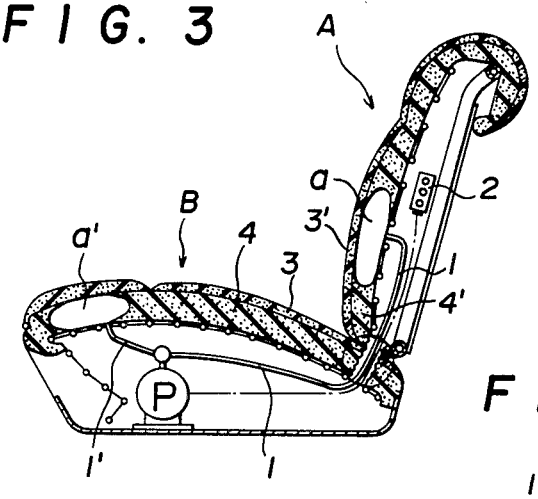
FIG. 3 is a longitudinally sectional view of the above seat of the invention; and, FIG. 4 is a longitudinally sectional view of a guide tube employed in the present invention.
Figure 4:
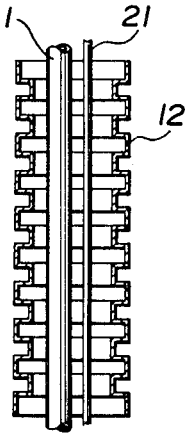

FIG. 3 illustrates a longitudinal sectional view of the present seat, showing a state in which the air feed pipe (1) for feeding air to the above-mentioned air bag (a) is inserted from the seat cushion (B) into the seat back (A). In other words, top members (3) (3') and cushion members (4) (4') are respectively formed with through bores (10) (11) in their respective portions located in the connecting portions of the seat cushion (B) and seat back (A). Then, a guide pipe (12) is inserted within the above-mentioned through bores (10) (11) and the air feed pipe (1) is inserted through the guide pipe (12), (FIGS. 3 and 4). As shown in FIG. 4, the guide pipe (12) is formed in a bellows-like configuration so that it can be expanded and bent.

Although in the illustrated embodiment of the invention there is mounted the guide pipe (12) within the through bores (10) (11) formed in the connecting portions of the seat cushion (B) and seat back (A), the harness means such as the air feed pipe (1) and a wire (21) may be inserted into the through bores (10) (11) directly without mounting of the above-mentioned guide pipe (12).

As disclosed hereinbefore, according to the invention, since in the respective connecting portions of the seat cushion and seat back there are formed through bores for communicating the seat cushion with the seat back internally thereof, it is possible to insert the harness means from the seat cushion into the seat back by means of such through bores. Accordingly, in the present invention, since the harness means are not exposed outside of the seat, there is no possibility that the harness may catch the foot of an occupant of the present seat or there is no possibility of the exposed harness impairing the appearance of the seat. Also, mounting of the guide pipe within the through bores facilitates the insertion of the harness and at the same time prevents the top members and cushion members against wear due to the harness. Thus, the present invention is highly advantageous in many aspects over the conventional vehicle seat of the same type.

What is claimed is:

1. In a vehicle seat comprising a seat cushion, a seat back, both of said seat cushion and seat back being separately formed from each other, said seat back being inclinably mounted to said seat cushion, harness means inserted from said seat cushion into said seat back through bores holes formed in each of said seat cushion and said seat back at a common point along the junction of said seat cushion and said seat back whereby through bores provide continuous communication between said seat cushion and said seat back for insertion of said harness means therethrough, the improvement comprising:

a guide pipe mounted within said through bores of said seat cushion and said seat back whereby said harness means is circumferentially enclosed at said common point along said junction.

2. The vehicle seat as set forth in claim 1, wherein said guide pipe is expandable and bendable.

3. The vehicle seat as set forth in claim 1, wherein said harness means comprises an air pipe and a cable.

* * * * *